United States Patent [19]

Rogers et al.

[11] 4,103,121

[45] Jul. 25, 1978

[54] SWITCH OPERATING MECHANISM

[75] Inventors: Edward J. Rogers, Chicago; Roy T. Swanson, North Riverside, both of Ill.

[73] Assignee: S & C Electric Company, Chicago, Ill.

[21] Appl. No.: 670,743

[22] Filed: Mar. 26, 1976

[51] Int. Cl.[2] ..... H01H 31/00

[52] U.S. Cl. ..... 200/48 A; 200/48 R; 335/1

[58] Field of Search ..... 200/48 A, 48 R; 335/1

[56] References Cited

U.S. PATENT DOCUMENTS

| | | | |
|---|---|---|---|
| 2,978,558 | 4/1961 | Barta | 200/48 R |
| 3,508,178 | 4/1970 | Chabala et al. | 200/48 R |

*Primary Examiner*—Stephen J. Lechert, Jr.
*Attorney, Agent, or Firm*—Kirkland & Ellis

[57] ABSTRACT

Main contact and interrupter contact operating rods of opposed current interrupters are sequentially moved by a spring loaded operating mechanism to open the main contacts and interrupting contacts of the interrupter switches. Rotation of an input shaft trips a first overcenter toggle linkage by the engagement of a cam on a drive lever operably connected to the shaft. Tripping of the first overcenter toggle linkage allows the springs to rapidly move a main rod arm assembly connected to the main contact operating rods to open the main contacts. Rotation of the main rod arm assembly trips a second overcenter toggle linkage connected to a fast rod arm assembly permitting springs to rotate the fast rod arm assembly connected to the interrupter contact rods to open the interrupting contacts in sequence. Continued rotation of the shaft in the same direction causes abutments on the drive lever to engage the main rod arm assembly and the fast rod arm assembly to recock the mechanism for subsequent operation. The mechanism can also be tripped by an auxiliary mechanism independent of the rotation of the shaft. An indicator operably connected to the main contact rods provides a visible indication of the position of the main contact rods thereby indicating the position of the contacts. Also, an alignment means is provided for permitting angular alignment between the rotatable supporting insulator and the input shaft.

21 Claims, 19 Drawing Figures

SWITCH OPERATING MECHANISM

BACKGROUND OF THE INVENTION

1. Field of the Invention

The present invention relates to improved switch operating mechanisms, and more particularly, to improved switch operating mechanism for operating two high voltage current interrupters simultaneously.

2. Description of the Prior Art

The present invention constitutes an improvement over the inventions disclosed in U.S. Pat. No. 3,769,447, issued Oct. 30, 1973; U.S. Pat. No. 3,345,473, issued Oct. 3, 1967; U.S. Pat. No. 3,225,170, issued Dec. 21, 1965; U.S. Pat. No. 3,030,481, issued Apr. 17, 1962; U.S. Pat. No. 3,163,736, issued Dec. 29, 1964; U.S. Pat. No. 3,194,928, issued July 13, 1965; U.S. Pat. No. 3,244,826, issued Apr. 5, 1966; and U.S. Pat. No. 3,508,178, issued Apr. 21, 1970.

As pointed out by the prior art references, it is desirable to provide a mechanism for sequentially operating main and interrupting contacts in high voltage current interrupters very rapidly and positively in the proper time sequence. It is also desirable to provide a means for recocking the mechanism and closing the contacts. Another desirable feature is to provide an auxiliary trip means for operating the mechanism through the use of an auxiliary remotely controlled mechanism. Also, it is desirable to have some form of indicator means for indicating the condition of the interrupter contacts so that the operator can visually determine whether the contacts within the current interrupters are open or closed. Further, since the present invention will be assembled in the field, it is desirable to have some means of properly aligning the supporting insulator with the input shaft.

The present invention provides improved and unique means for achieving these desirable features.

BRIEF DESCRIPTION OF THE INVENTION

The present invention is for use in a high voltage switch arrangement. The switch arrangement comprises a base, insulators mounted on the base, and a first and a second current interrupters mounted on the insulators. The current interrupters include main contact rods connected to separable main contacts that are adapted to carry continuous high voltage current, and interrupting contact rods connected to separable interrupting contacts adapted to separate to interrupt high voltage current when separated after the main contacts are opened. A first rotatable insulator is mounted on the base and adapted to be rotated by a driven mechanism, and an auxiliary operating mechanism is also mounted on the base and connected to a second rotatable insulator.

An improved switch operating mechanism in accordance with the present invention comprises a rotatably mounted shaft connected to the first rotatable insulator. A main drive lever is mounted on the shaft for rotation with the shaft and the main drive lever includes a cam means. A main rod arm assembly is mounted for rotation around the shaft independent of the rotation of the main drive lever and the shaft, and the main rod arm assembly is operably connected to the main contact rods. A fast rod arm assembly is mounted for rotation around the shaft independent of the rotation of the main drive lever and the shaft, and the fast rod arm assembly is operably connected to the interrupting contact rods.

A first bias means urges the main rod arm assembly to rotate in a direction to cause the main contact rods to move to open the main contacts. A second bias means urges the fast rod arm assembly to rotate in a direction to cause the interrupting contact rods to move to open the interrupting contacts. A first overcenter toggle linkage means is operably connected to the main rod arm assembly and prevents rotation of the main rod arm assembly when the first overcenter toggle linkage means is in an overcenter toggle position. A second overcenter toggle linkage means is operably connected to the fast rod arm assembly and prevents rotation of the fast rod arm assembly when the second overcenter toggle linkage means is in an overcenter toggle position. A latch means is mounted on the first overcenter toggle linkage means and is positioned to engage the cam means on the main drive lever when the shaft is rotated and to move the first overcenter toggle linkage means out of the overcenter toggle position so that the main rod arm assembly can be rotated under the urging of the first bias means to open the main contacts.

Kicker means are mounted on the main rod arm assembly and positioned to engage the second overcenter toggle linkage means when the main rod arm assembly is rotated to a predetermined position and to move the second overcenter toggle linkage means out of the overcenter toggle position so that the fast rod arm assembly can be rotated under the urging of the second bias means to open the interrupting contacts.

A recocking means is provided for rotating the main rod arm assembly and the fast rod arm assembly in a direction against the urging of the first and second bias means to close the main and interrupting contacts and to move the first and second overcenter toggle linkage means back into the overcenter toggle position by continued rotation of the shaft in the same direction.

Also provided on the main rod arm assembly are first abutments positioned for engaging second abutments on the fast rod arm assembly so that when the main rod arm assembly is rotated rapidly under the urging of the first bias means, the first abutments will strike the second abutments after the second overcenter toggle linkage means has moved out of the overcenter position thereby transferring kinetic energy from the main rod arm assembly to the fast rod arm assembly to accelerate the opening of the interrupting contacts. In addition, a pryout means may be provided for applying direct leverage force from the main drive lever to the main rod arm assembly to rotate the main rod arm assembly if the first bias means does not provide sufficient force to separate the main contacts. This feature is desirable in the event the main contacts have become welded or stuck so that the first bias means does not provide sufficient force to separate these contacts.

The present invention also provides a unique alignment means for facilitating angular alignment between the shaft and the first rotatable insulator and for locking the shaft and first rotatable insulator in the correct angular alignment. The present invention also provides an indicator means for indicating the position of the current interrupter contacts so that the operator can easily determine whether the contacts are opened or closed. Further, the present invention provides an auxiliary operating means for causing the first overcenter toggle linkage means to move out of the overcenter toggle position independent of the rotation of the shaft so that the mechanism can be operated and the current interrupters opened by an auxiliary operating mechanism.

Thus, it is a primary object of the present invention to provide an improved operating mechanism for high voltage switches which delivers more accelerating force at predetermined positions of the overall stroke of the mechanism.

An additional feature of the present invention is to provide an improved operating mechanism for high voltage switches which provides a simplified linkage system which combines the trip latch and pryout means.

Yet another object of the present invention is to provide an improved switch operating mechanism for high voltage switches which has an improved means of recocking the mechanism.

Another object of the present invention is to provide an operating mechanism for operating high voltage switches that has a unique alignment means for angularly aligning the input shaft of the mechanism with the operating insulator.

These and other objects, advantages, and features of the present invention will hereinafter appear, and for the purpose of illustration, but not for limitation, an exemplary embodiment of the present invention is illustrated in the attached drawings.

DETAILED DESCRIPTION OF THE PREFERRED EMBODIMENT

Figure 1:
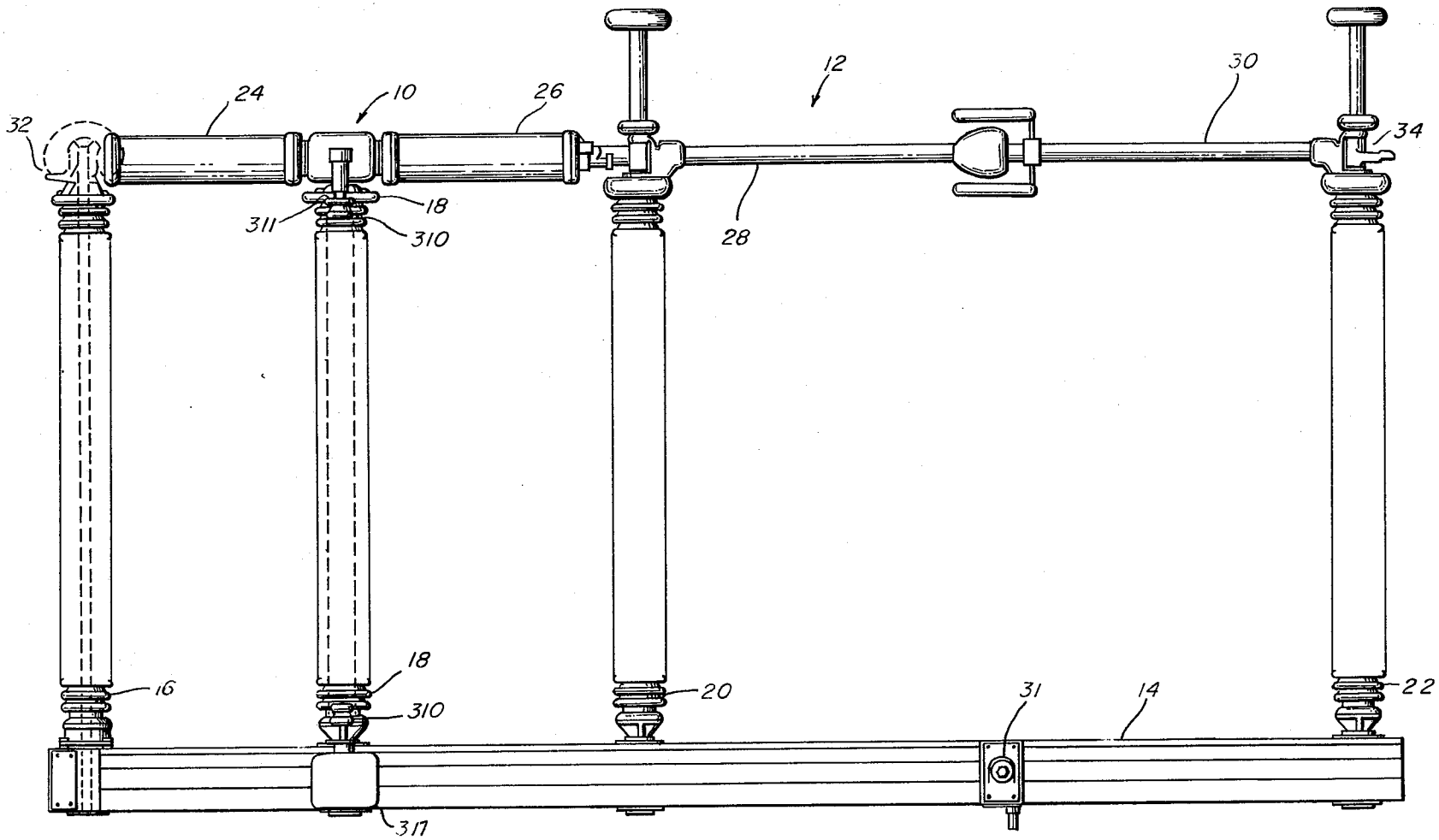
FIG. 1 is a side elevational view of a preferred embodiment of the present invention mounted on a conventional current interrupter and disconnect switch arrangement.
Figure 2:
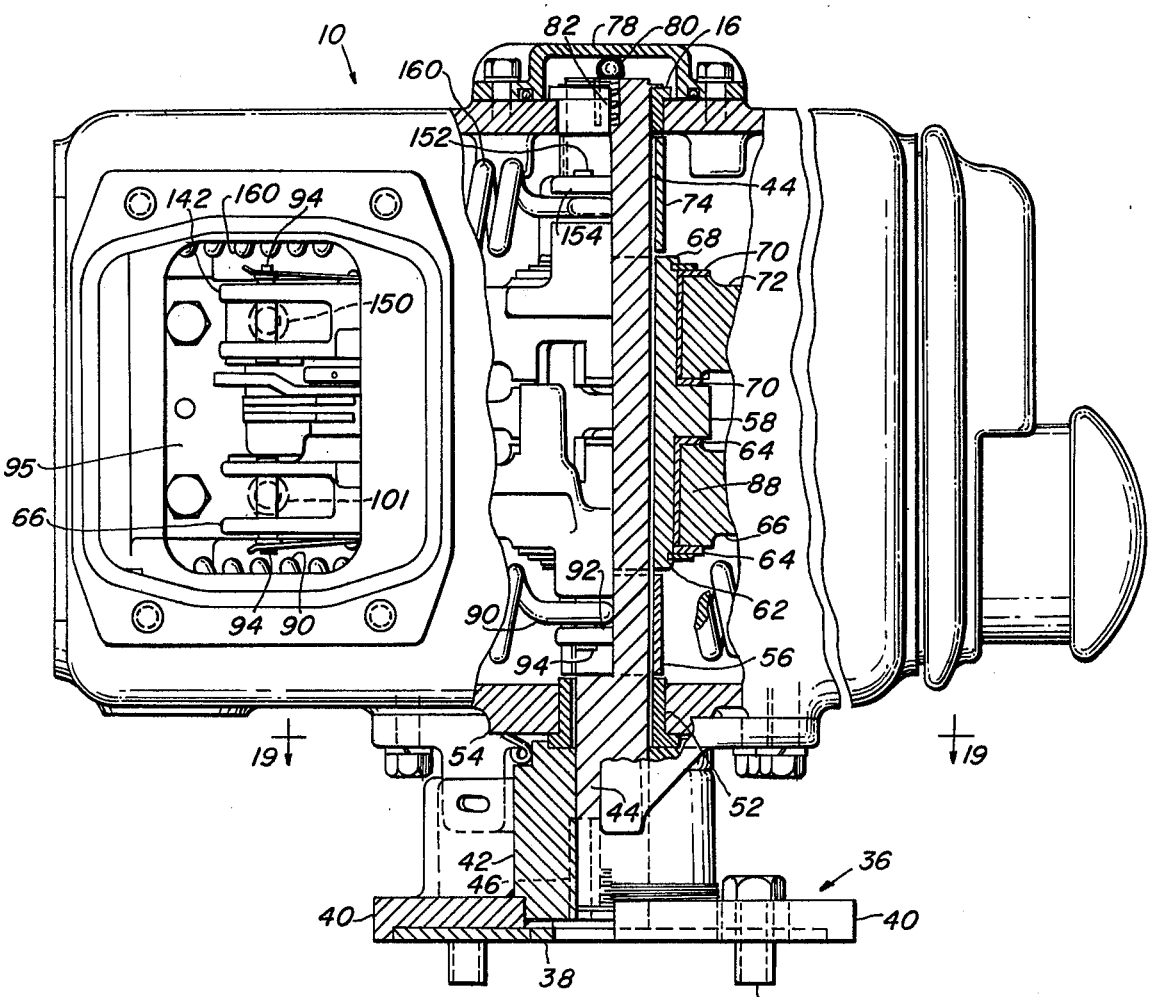
FIG. 2 is a side partially fragmentary partially cross-sectional view of the preferred embodiment of the present invention.

With respect to FIG. 1, current interrupter operating mechanism 10 is shown mounted on a high voltage switch arrangement generally designated by the numeral 12. High voltage switch arrangement 12 comprises a hollow metal support beam 14 upon which are mounted insulators 16, 18, 20, and 22. Mechanism 10 is mounted on top of insulator 18, and mounted between mechanism 10 and insulator 16 is current interrupter 24. Mounted between mechanism 10 and insulator 20 is current interrupter 26. Mounted for pivotable movement on top of insulator 20 is a first disconnect switch blade 28. Mounted on top of insulator 20 for pivotable movement is second disconnect switch blade 30. Insulator 18 is mounted for rotational movement and an operating linkage mechanism 31 is connected to insulator 18 (through linkage within supporting beam 14) and arranged to rotate the insulator 18 as a result of operation of linkage 31.

High voltage switch arrangement 10 comprises a single pole of a three-phase switch assembly that commonly is employed for controlling the three-phase high voltage alternating current circuits. One side of a high voltage circuit is ordinarily connected to a line terminal 32 on top of insulator 16 and the other side of the high voltage circuit is connected to a line terminal 34 on top of insulator 22. Thus, in the normal contact closed position, a high voltage circuit is formed through current interrupter 24, mechanism 10, current interrupter 26, and switch blades 28 and 30. Current interrupters 24 and 26 may take a variety of forms. For example, interrupter switches 24 and 26 may be constructed in the manner disclosed in U.S. Pat. No. 3,163,736 - Mikos et al., issued Dec. 29, 1964. In normal operation, current interrupters 24 and 26 are first operated to interrupt current in the circuit, and then blades 28 and 30 are opened to visually disconnect the circuit.

With reference to FIGS. 2, 3, 4, and 19, current interrupter operating mechanism 10 is mounted to the top of rotatable insulator 18 by flange assembly 36. Flange assembly 36 comprises a guide ring 38 positioned in a recess in the bottom of a base plate 40. Guide ring 38 has slots 39 (FIG. 19) formed around its periphery and base plate 40 has two slots 41 positioned over two opposed slots 39 and two larger slots 43 positioned over two other opposed slots 39. Eccentric disks 45 having offcenter openings therethrough are positioned in slots 43. A cylindrical support 42 is welded to base plate 40. Through the hollow interior of cylindrical support 42 is positioned a shaft 44 that is keyed to cylindrical support 42 by a key 46 (FIG. 19) riding in a machined keyway. Guide ring 38 and base plate 40 are bolted to the top of insulator 18 by bolts 48 through slots 41 and bolts 40 are inserted through eccentric disks 45 as will be more fully described hereinafter. Positioned around shaft 44 and riding in a recess on the top of cylindrical support 42 is a bearing 52. Bearing 52 also supports the bottom of housing 54 of mechanism 10 so that insulator 18, flange assembly 36, and shaft 44 can freely rotate with respect to housing 54.

Positioned immediately above bearing 52 and around shaft 44 is a cylindrical spacer 56. Positioned around shaft 44 immediately above spacer 56 is drive lever assembly 58 that is keyed to shaft 44 by a key 60 (see FIG. 3) so that drive lever assembly 58 rotates with shaft 44. Mounted for independent rotation around a lower cylindrical extension 62 of drive lever assembly 58 and riding on bearings 64 is main rod arm assembly 66. Mounted for independent rotation around an upper cylindrical extension 68 of drive lever assembly 58 on bearings 70 is fast rod arm assembly 72. Positioned around shaft 44 between extension 68 of drive lever assembly 58 and the top of housing 54 is spacer 74. Shaft 44 is supported for rotation at the top of housing 54 by a bearing 76. A cap 78 is bolted to the top of housing 54 and a stainless steel ball 80 riding on top of a spring 82 positioned in a recess in the top of shaft 44 provides a positive electrical connection between shaft 44 and housing 54.

With reference to FIGS. 2, 3, 4, 5, and 6, main rod arm assembly 66 comprises two arms 84 and 86 extending outwardly from a cylindrical portion 88 which rides on lower cylindrical extension 62 of drive lever assembly 58. Springs 90 are attached at one end by pins 94 through flanges 92 on the bottom of main rod arm assembly 66, and at the other end to spring support assemblies 89 and 91. Thus, main rod arm assembly 66 is urged in a clockwise direction as viewed in FIG. 5 by the force of springs 90 providing force in the direction of arrow A in FIG. 5. Also formed on main rod arm assembly 66 are abutments 96 which extend upwardly from main rod arm assembly 66. The purpose of abutments 96 will be explained below. Connected to the end of arms 84 and 86 are main interrupter switch main contact rod arms 99 and 101 which extend through openings 95 through the side of housing 54 into interrupter switches 24 and 26. Current interrupters 24 and 26 are arranged so that movement of main contact rod arms 99 and 101 in the direction indicated by arrow B in FIG. 5 causes the main current carrying contacts in current interrupters 24 and 26 to open. Such main contacts are provided to carry continuous high voltage current as more fully explained in U.S. Pat. No. 3,163,736 - Mikos et al.

Mounted on arm 86 by pin 98 is trip latch 100. Trip latch 100 has a slot 102 through it in which pin 98 rides. Trip latch 100 has a hook end 104 extending outwardly therefrom which serves as an auxiliary tripping means as will be more fully described later. Trip latch 100 is also pivotably mounted by pin 106 to main toggle latch 108. Main toggle latch 108 is pivotably mounted by pin 110 to a flange 112 on spring support assembly 91 mounted to housing 54. Main toggle latch 108 has a curved end 111 that engages a stop screw 113 threaded through flange 112 so that main toggle latch 108 cannot pivot counterclockwise as viewed in FIG. 5 any further than the position illustrated. In this position, the center lines of trip latch 100 and toggle latch 108 are positioned at a slight angle F with respect to one another thereby being in an overcenter toggle condition preventing springs 90 from rotating main rod arm assembly 66 in a clockwise direction as viewed in FIG. 5. Trip latch 100 and main toggle latch 108 form a first overcenter toggle linkage means.

Also pivotably mounted by pin 106 at the junction between trip latch 100 and main toggle latch 108 at approximately its center is latch 114. Pinned to the end of latch 114 by pin 116 is pryout link 118. Pryout link 118 has slots 120 and 122 formed through opposite ends thereof through which pins 116 and 98 ride respectively.

Figure 11:
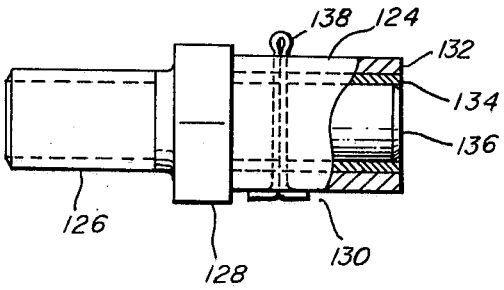
FIG. 11 is a side partially cross-sectional view of the fast rod actuating kicker of the present invention.
Figure 12:
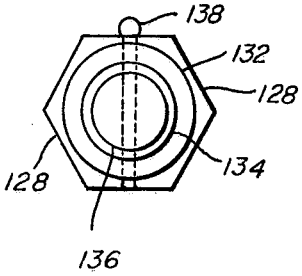
FIG. 12 is an end view of the kicker illustrated in FIG. 11.

Mounted on arm 84 of main rod arm assembly 66 is fast rod actuating kicker 124. With reference to FIGS. 11 and 12, kicker 124 has a threaded portion 126 which extends into a mating threaded opening in arm 84, a hexagonal portion 128 which permits wrench tightening, and a circular portion 130 which extends upwardly from arm 84. Circular portion 130 comprises an outer sleeve 132 which is formed of metal, a resilient sleeve 134 formed of a resilient material and a central metal column 136. Resilient sleeve 134 and outer sleeve 132 are held in position on central column 136 by a pin 138.

With reference to FIGS. 2, 3, 4, and 6, fast rod assembly 72 comprises arms 140 and 142 extending outwardly from a cylindrical central portion 144 that independently rotates on upper cylindrical extension 68 of drive lever assembly 58. Attached to the ends of arms 140 and 142 by pins 146 are interrupter contact rods 148 and 150. Interrupting contact rods 148 and 150 extend into current interrupters 24 and 26 and movement of rods 48 and 50 in the direction of arrow C in FIG. 6 causes the interrupting contacts in current interrupters 24 and 26 to open thereby interrupting current after the main contacts open.

Figure 6:
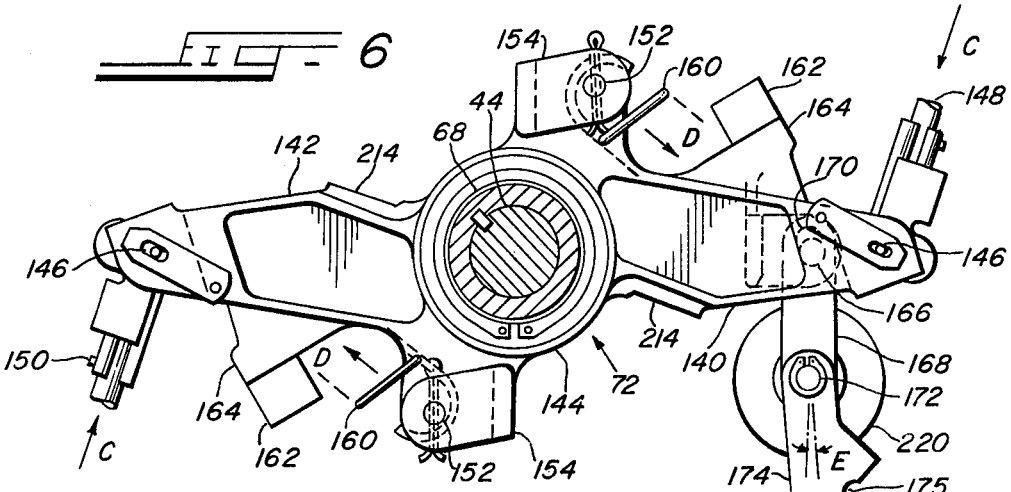
FIG. 6 is a top view taken substantially along line 6—6 in FIG. 4.

Pins 152 extend through flanges 154 extending upwardly from the top of fast rod arm assembly 72, and one end of springs 160 are hooked on pins 152. The other end of springs 160 are attached to spring support assemblies 89 and 91 (see FIG. 3) causing force to be exerted in the direction of arrow D in FIG. 6 thereby tending to urge fast contact arm assembly 72 to rotate in a clockwise direction as illustrated in FIG. 6.

Resilient pads 162 are mounted on abutments 164 extending from arms 140 and 142, and positioned to engage abutments 96 on main rod arm assembly 66 as will be described later.

Pivotably mounted towards the end of arm 140 by pin 166 is toggle link 168. Toggle link 168 has a slot 170 formed in the end thereof through which pin 166 rides. Pivotably connected to the other end of toggle link 168 by a pin 172 is toggle link 174. The opposite end of toggle link 174 is pivotably connected to flange 176 on spring support assembly 89 by pin 178. Toggle link 174 has a curved end 180 that engages a stop screw 182 threaded through flange 176 that prevents the rotation of toggle link 174 in a counterclockwise direction as viewed in FIG. 6 any further than is illustrated. In the position illustrated, the center lines of toggle links 168 and 174 are positioned at a slight angle E with respect to each other thereby being in an overcenter toggle condition preventing springs 160 from rotating fast rod arm assembly 72 in a clockwise direction as illustrated in FIG. 6. Toggle links 168 and 174 form a second overcenter toggle linkage means.

Figure 5:
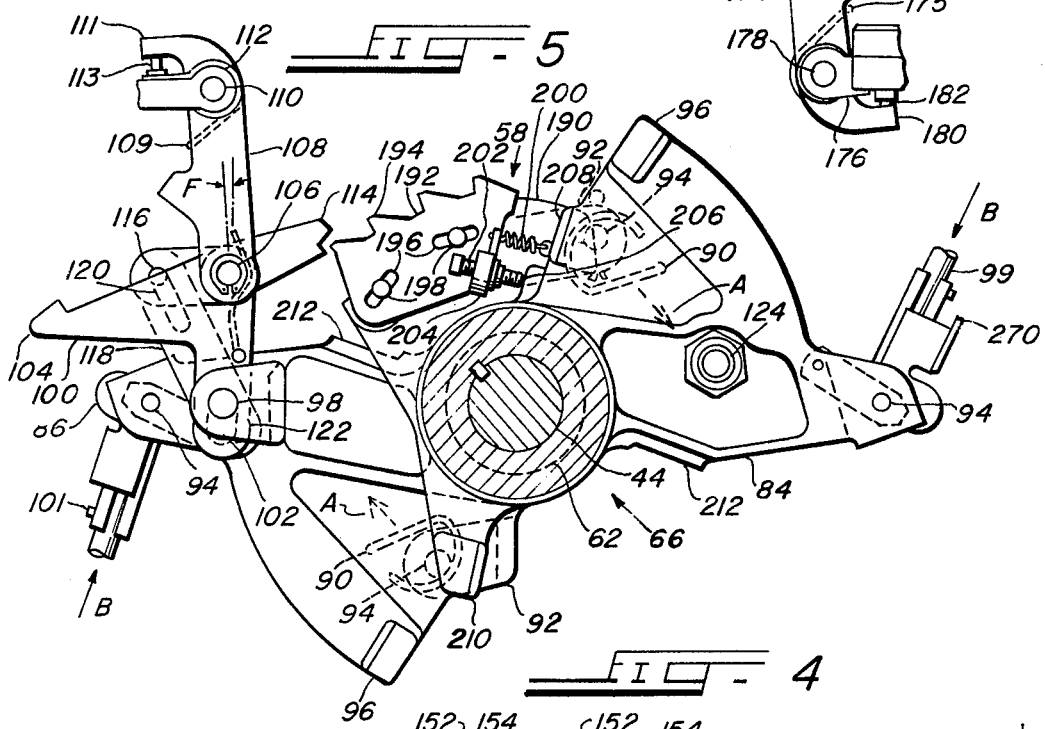
FIG. 5 is a top cross-sectional view taken substantially along line 5—5 in FIG. 4.
Figure 4:
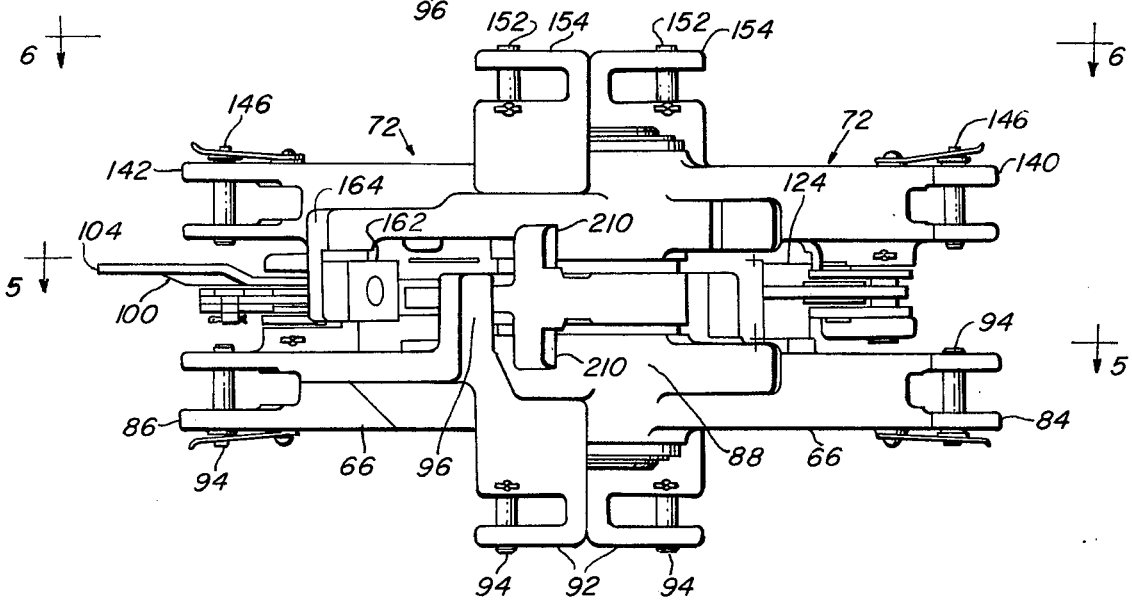
FIG. 4 is a side view of the operating members of the present invention taken substantially along the plane designated 4—4 in FIG. 3.

With reference to FIG. 5, drive lever assembly 58 has an arm 190 extending radially therefrom upon which is mounted a cam 192 having several engaging teeth 194 formed along the edge thereof. Cam 192 has slots 196 formed therein and pins 198 through slots 196 retain cam 192 in sliding engagement against arm 90. A spring 200 tends to urge cam 192 to the right as illustrated in FIG. 5 until stop screw 202 threaded through a flange 204 on cam 192 engages an abutting surface 206 on arm 190. The relative position of cam 192 on arm 190 can be adjusted by adjusting stop screw 202. Drive lever assembly 58 also comprises abutting flanges 208 and 210 which extend outwardly and are adapted to engage abutting surfaces 212 on main rod arm assembly 66 and abutting surface 214 on fast rod arm assembly 72 when drive lever assembly 58 is rotated in a manner described hereinafter.

With reference to FIGS. 6, 10, 13, and 14, mounted on pin 172 at the pivotable connection between toggle links 168 and 174 is roller assembly 220. Roller assembly 220 comprises an annular metallic disk portion 222, an annular resilient portion 224 formed of a resilient material, and an inner metallic annular ring 226. Ring 226 has an opening 228 through the center thereof through which pin 172 extends.

Figure 3:
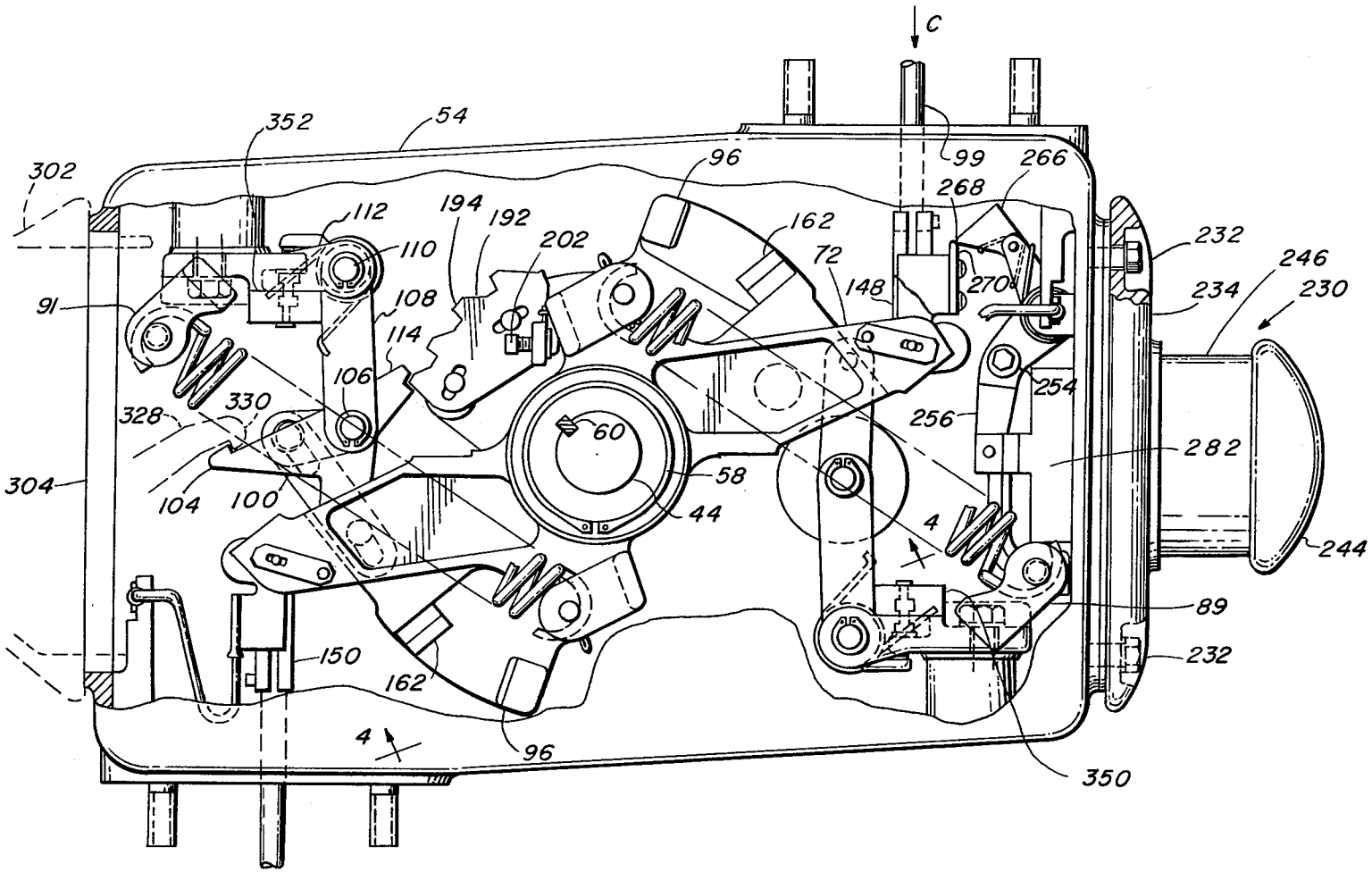
FIG. 3 is a top partially fragmentary view of the preferred embodiment of the present invention.
Figure 18:
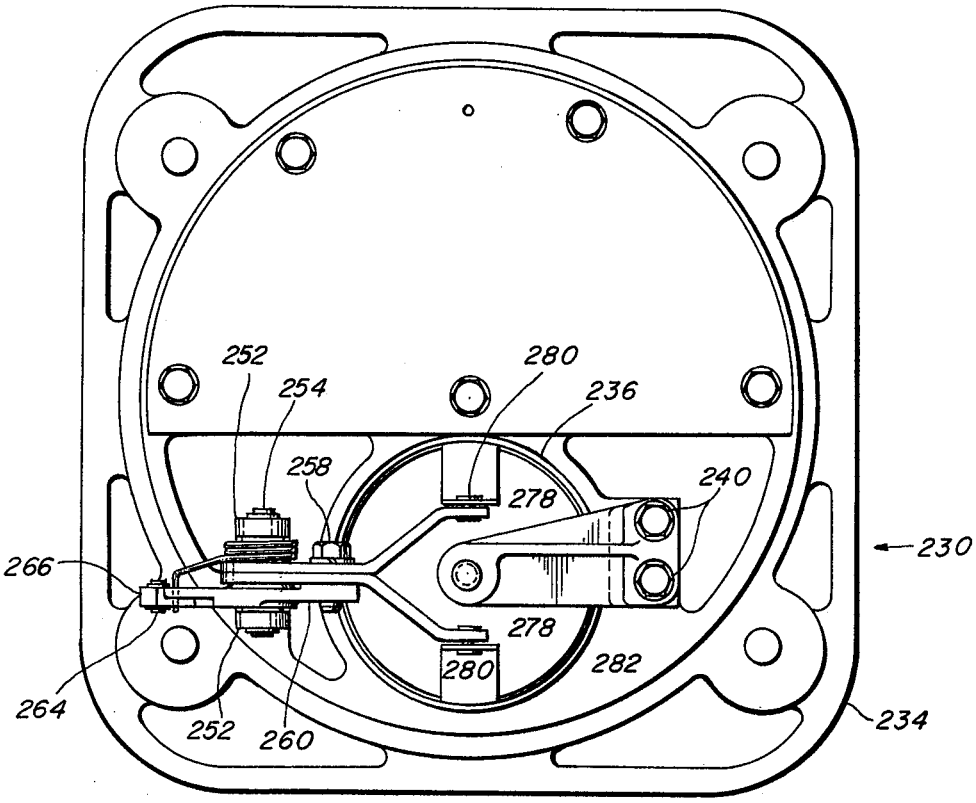
FIG. 18 is a side view of the indicator and aerator assembly illustrated in FIG. 17 taken substantially along line 18—18 in FIG. 17.
Figure 17:
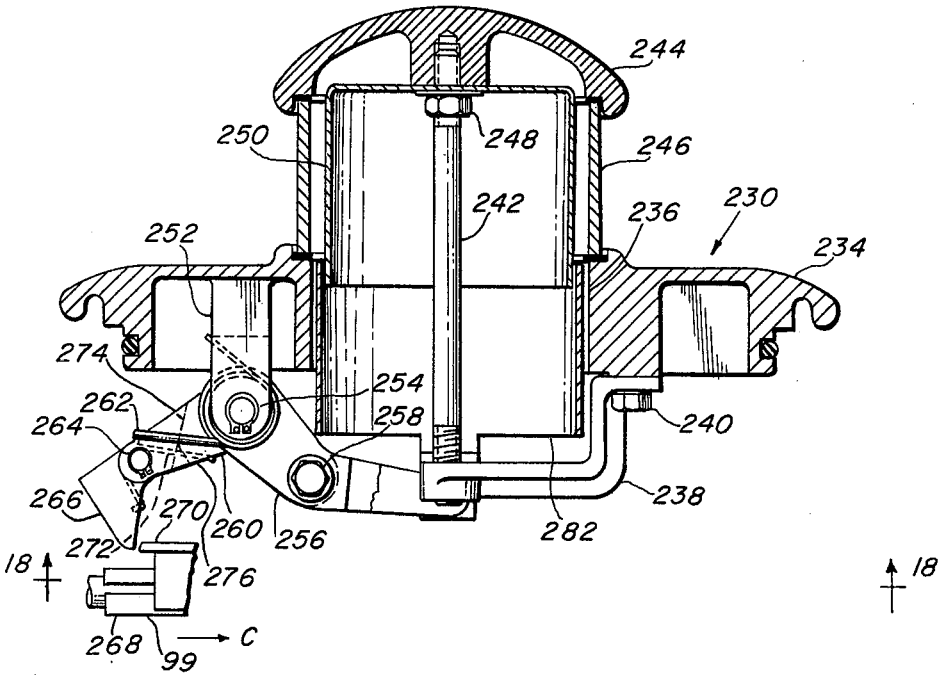
FIG. 17 is a top cross-sectional view of the indicator and aerator assembly of the present invention.

With reference to FIGS. 3, 17, and 18, indicator and aerator assembly 230 is bolted to housing 54 by bolts 232. Indicator and aerator assembly 230 comprises a cover 234 having an opening 236 formed therethrough. A bracket 238 is bolted to the back of cover 234 by bolts 240 and extends to approximately the center of opening 236. A rod 242 is threaded into the end of bracket 238 and extends through opening 236. A cover 244 is mounted to the other end of rod 242 and retains a transparent cylindrical window 246 against cover 234. Also mounted between cover 244 and a nut 248 on the end of rod 242 is a target sleeve 250. Target sleeve 250 is colored a particular color that is visible through transparent window 246. Mounted on a flange 252 extending from the inside of cover 244 by a pin 254 is actuating lever arm 256. Also pivotably mounted on pin 254 and bolted to lever arm 256 by bolt 258 is lever 260. A spring 262 is mounted around pin 254 and tends to urge lever arms 256 and 260 in a counterclockwise direction around pin 254 as viewed in FIG. 17.

Mounted on the end of lever arm 260 by pin 264 is finger 266. Finger 266 has an extended end 268 that engages an abutment 270 on main contact rod 99. A spring 272 mounted around pin 264 tends to urge finger 266 in a clockwise direction around pin 264 as viewed in FIG. 17 until an abutting surface 274 on the edge of finger 266 engages a recess abutting surface 276 on the underside of lever arm 260 thereby holding finger 266 in the position illustrated in FIG. 17 but permitting finger 266 to rotate in a counterclockwise direction as viewed in FIG. 17 around pin 264.

Mounted on the bifurcated ends 278 of lever arm 256 by rivets 280 is a second target sleeve 282. Thus, if main contact rod 99 moves in the direction of arrow C in FIGS. 3 and 17, actuating lever arm 256 and lever arm 260 are pivoted by spring 262 around pin 254 in a counterclockwise direction as viewed in FIGS. 3 and 17 thereby pushing second target sleeve 282 over first target sleeve 250 so that second target sleeve 282 is viewable through window 246. Second target sleeve 282 is of a different color than first target sleeve 250 thus providing an indicating means for indicating to the external viewer when interrupter main contact rod 99 has moved to a position opening the main contacts within the current interrupters.

Figure 15:
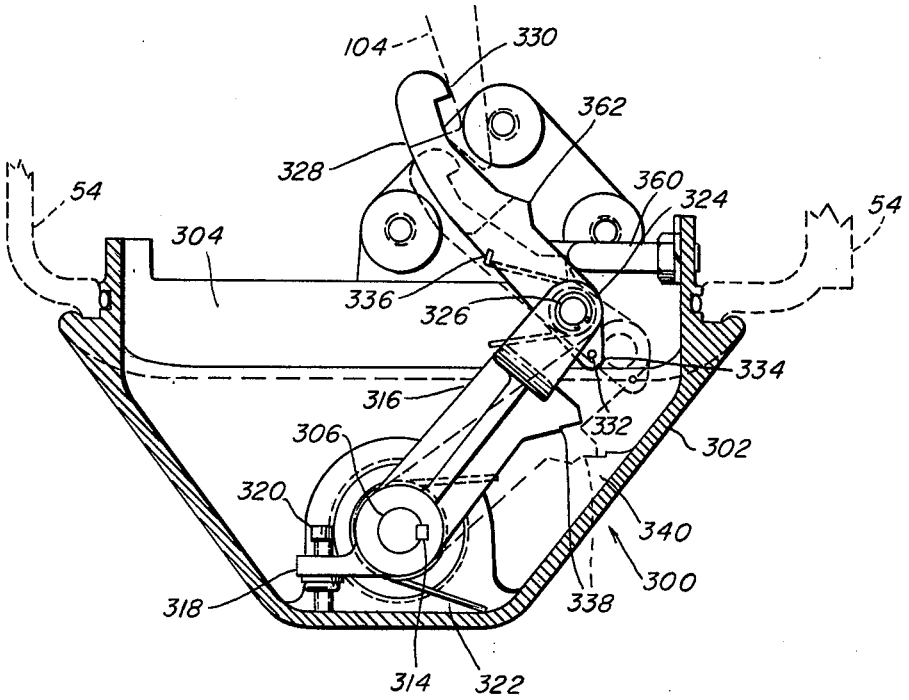
FIG. 15 is a top cross-sectional partially fragmentary view of the auxiliary operating assembly of the present invention.
Figure 16:
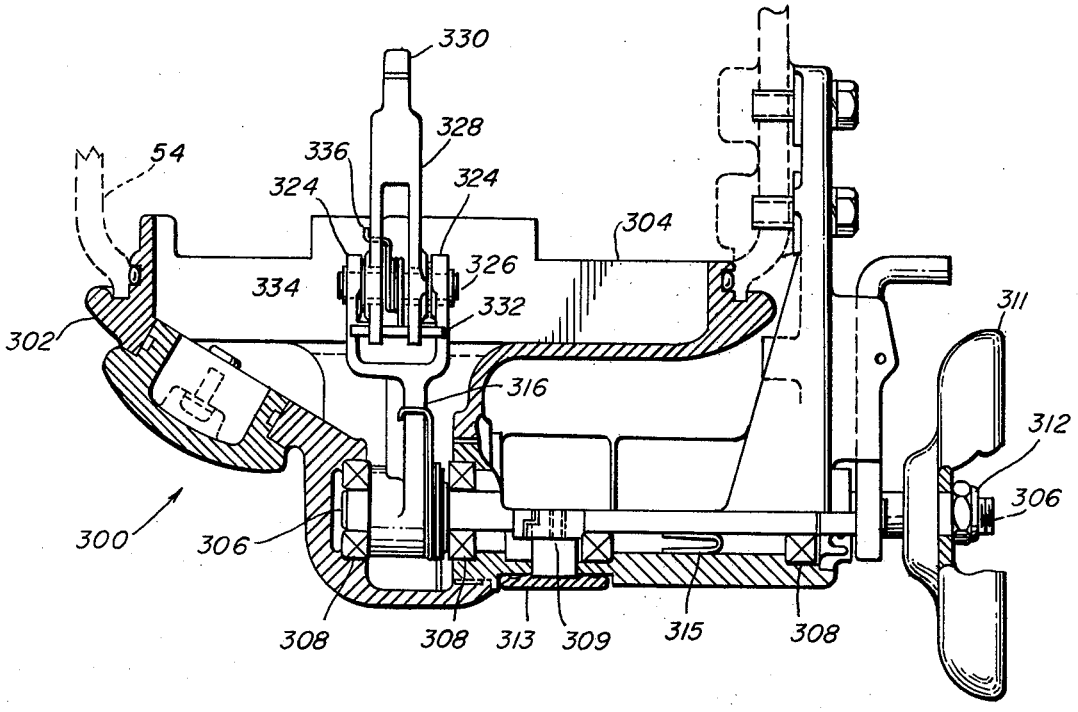
FIG. 16 is a side cross-sectional partially fragmentary view of the auxiliary operating assembly illustrated in FIG. 15.

With reference to FIGS. 15 and 16, an auxiliary operating linkage assembly 300 is illustrated. Assembly 300 comprises a cover 302 that is mounted over an opening 304 through the side of housing 54 of mechanism 10 (see FIG. 3). A shaft 306 is mounted for rotation by bearings 308 in cover 302 and extends through an opening in the bottom of cover 302. The end of shaft 306 is connected to flange 311 mounted on rotatable insulator 310 by a nut 312 and the end of shaft 306 has flat surfaces (not shown) which engage mating flat surfaces in the opening in flange 311 so that when insulator 310 is rotated, shaft 306 also rotates. Tongue and groove universal joint 309 accommodates some axial misalignment of insulator flange 311 and facilitates the removal of cover 302 from housing 54 without disassembly of insulator 310. Flexible boot 313 protects joint 309 from the elements. U-shaped metal spring 315 provides a definite electrical connection between shaft 306 and housing 54.

Mounted on shaft 306 and keyed thereto by key 314 is actuating lever 316. Actuating lever 316 has formed at one end thereof a flange 318 through which a stop screw 320 is threaded to engage the back edge of cover 302 so that actuating lever 316 cannot rotate in a counterclockwise direction any further than the position illustrated in FIG. 15. A spring 322 is positioned around shaft 306 and engages actuating lever 316 and urges actuating lever 316 in a counterclockwise direction as viewed in FIG. 15. An abutting surface 340 formed on the interior of cover 302 so that actuating lever 316 can only pivot to the position illustrated in dotted lines in FIG. 15.

Mounted through the bifurcated ends 324 of actuating lever 316 is a pin 326. Pivotably mounted on pin 326 is actuating arm 328 that has a hooked tip 330 formed on the end thereof positioned to engage hook end 104 of trip latch 100. A pin 332 is positioned through bifurcated tips 334 on actuating arm 328. A spring 336 mounted around pin 326 biases actuating arm 328 to pivot in a clockwise direction as illustrated in FIG. 15 until pin 332 engages the edge of bifurcated ends 324 of actuating lever 316.

Mechanism 10 operates in the following manner. To interrupt current flow through interrupter switches 24 and 25 prior to the opening of switch blades 28 and 30, linkage 31 is operated to cause insulator 18 to rotate. The rotation of insulator 18 causes flange assembly 36 and shaft 44 to also rotate. Shaft 44 is rotated in a counterclockwise direction as viewed in FIGS. 3, 5, 6, 7, 8, and 9. Normally, main toggle latch 108 and trip latch 100 are initially positioned in an overcenter toggle position as previously described so that the small angle F (see FIG. 5) formed between the center lines of latches 100 and 108 prevents rotation of main rod arm assembly 66 by springs 90, which are normally urging main rod arm assembly 66 in a clockwise direction as viewed in FIG. 5. The overcenter toggle condition formed by trip latch 100 and main toggle latch 108 prevents rotation of main rod arm assembly 66 thereby locking the main rod arm assembly into position as illustrated in FIG. 5 until main toggle latch 108 and trip latch 100 move out of the overcenter toggle position.

Figure 7:
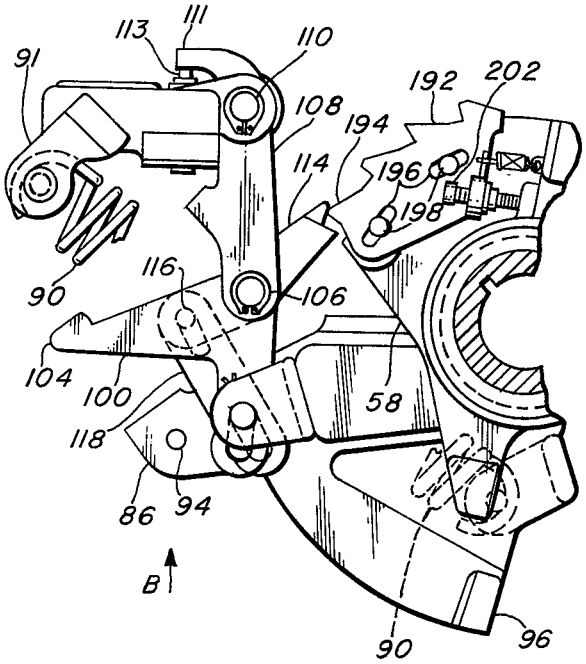
FIG. 7 is a partially fragmentary view of the first overcenter toggle linkage members in the initial position at the commencement of the sequence of operations.
Figure 8:
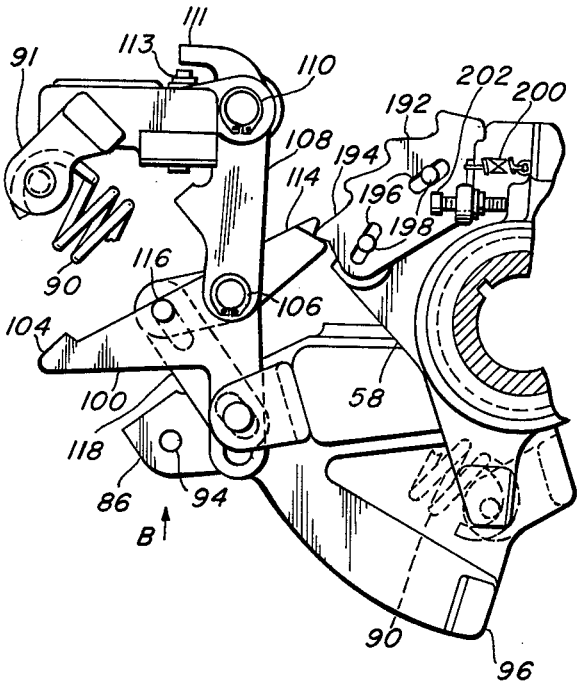
FIG. 8 is a figure corresponding to FIG. 7 showing the first overcenter toggle linkage members during the sequence of operation.

Rotation of shaft 44 in a counterclockwise direction as viewed in FIG. 5 causes a tooth 194 on cam 192 mounted on drive lever assembly 58 to move to engage the end of latch 114 as illustrated in FIG. 7. The continued rotation of shaft 44 causes cam 192 to push against latch 114 causing trip latch 100 and main toggle latch 108 to pivot out of the overcenter toggle position as illustrated in FIG. 8. At this point, there is nothing to prevent springs 90 from rotating main rod arm assembly 66 in a clockwise direction very rapidly thereby causing main contact rods 99 and 101 to move very rapidly in the direction of arrow B in FIG. 5. This movement causes the main current carrying contacts in current interrupters 24 and 26 to open.

Figure 10:
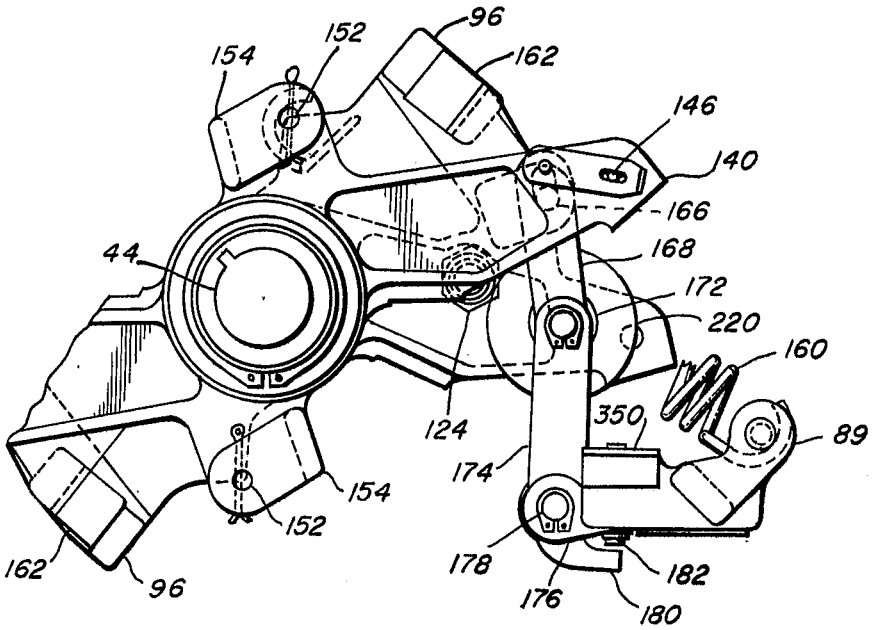
FIG. 10 is a cross-sectional partially fragmentary view of the fast rod arm assembly and the second overcenter toggle linkage members during the sequence of operation of the present invention.

As main rod arm assembly 66 rotates under the urging of springs 90, fast rod arm kicker 124 engages the edge of roller assembly 220 causing links 168 and 174 to move out of their overcenter toggle position as illustrated in FIG. 10 thereby permitting springs 160 to rotate fast rod arm assembly 172 in a clockwise direction as viewed in FIGS. 6 and 10. The rotation of fast rod arm assembly 72 causes interrupting contact rods 148 and 150 to move very rapidly in the direction of arrow C in FIG. 6 thereby opening the interrupting contacts within current interrupters 24 and 26 so that current flow through the circuit is interrupted.

This sequence of opening of the main and interrupting contacts is very important since it is required to open the main current carrying contacts of the interrupter switches 24 and 26 before the interrupting contacts are opened. The main contacts are provided for carrying continuous current flow whereas the interrupting contacts are specifically designed to interrupt current and to suppress a resultant arc when the interrupting contacts are opened.

To assist the rotation of fast rod arm assembly 72, abutments 90 on main rod arm assembly 66 engage resilient pads 162 on fast rod arm assembly 72 as main rod arm assembly 66 rotates just as links 168 and 174 move out of the overcenter toggle position. Thus, kinetic energy from the main rod assembly 66 is transmitted to fast rod arm 72 to assist in the rapid acceleration of that member. This acceleration assists in causing the interrupting contacts within the current interrupters 24 and 26 to separate with sufficient velocity to interrupt current.

As previously stated, fast rod arm kicker 124 has a resilient sleeve 134, and roller assembly 220 has an annular resilient portion 224 both of which act to absorb the shock resulting when kicker 124 strikes the edge of roller assembly 220.

Figure 9:
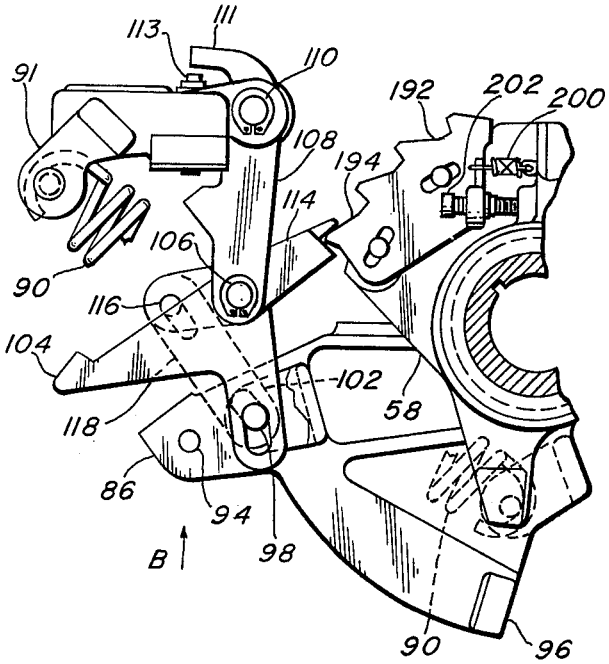
FIG. 9 is a partially fragmentary view corresponding to FIG. 7 but showing the first overcenter toggle linkage members in a further actuated position during the sequence of operation.
Figure 13:
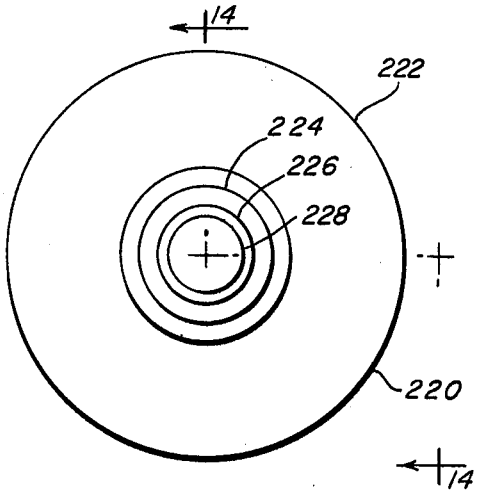
FIG. 13 is a plan top view of the roller assembly of the present invention.
Figure 14:
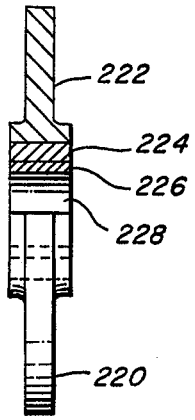
FIG. 14 is a side partially cross-sectional view of the roller assembly illustrated in FIG. 11.

In the event that the main contacts in current interrupters 24 and 26 have become stuck or welded together, a mechanical pryout means is provided by the action of pryout link 118. With reference to FIG. 9, in the event that the main contacts are welded or stuck together, when main toggle latch 108 and trip latch 100 move out of the overcenter toggle position, springs 90 may not provide sufficient force to open the main contacts. Consequently, main rod arm assembly 66 will not rotate. However, by the continued rotation of drive lever assembly 58, tooth 194 on cam 192 continues to push against the end of latch 114 causing latch 114 to pivot around pin 106 until pin 116 pulls pryout link 118 to the position illustrated in FIG. 9 where the end of slot 122 in pryout link 118 engages pin 98 on main rod assembly 66. Continued rotation of drive lever assembly 58 causes pryout link 118 to exert a force on pin 98 to pull main rod arm assembly 66 in a clockwise direction with substantial mechanical advantage thereby forceably pulling the stuck or welded main contacts apart so that spring 90 can operate to rotate main rod arm assembly 66.

With the mechanism tripped, main rod arm assembly 66 and fast rod arm assembly 72 pivot in a clockwise direction until the ends of these members strike stops 350 and 352 (see FIG. 3) mounted on spring support assemblies 89 and 91 thereby stopping the rotation of these members after the main and interrupting contacts have opened.

To recock the mechanism ready for the next operation, shaft 44 is continued to be rotated in the same direction until abutting flanges 208 and 210 on drive lever assembly 58 engage abutting surface 212 and 214 on main rod arm assembly 66 and fast rod arm assembly 72 respectively, thereby causing these members to rotate in a counterclockwise direction as viewed in FIGS. 3, 5, and 6. These members continue to rotate as shaft 44 rotates until trip latch 100 and main toggle latch 108 are rotated to a position where links 168 and 174 are pivoted back to the overcenter toggle position as illustrated in FIGS. 5 and 6 and the main and interrupter contacts are closed. Springs 175 and 109 are provided to assure that these members are pivoted back into the overcenter toggle position thereby locking the members in position. Also. slot 102 in trip latch 100 and slot 170 in toggle link 168 provide sufficient slack in the system to assure that all members will return to the overcenter toggle position.

As previously pointed out, when main contact rod 99 is pulled to the open position when main rod arm assembly 66 is rotated, extended end 268 on finger 266 of indicator assembly 230 disengages abutment 268 on main contact rod 99 thereby permitting second target sleeve 282 to slide over first target sleeve 250 so that it is externally viewable. This provides an externally visible indication of the position of the contacts within current interrupters 24 and 26.

An auxiliary method of operating mechanism 10 is through the use of auxiliary operating linkage assembly 300. As previously pointed out, shaft 306 is connected to an insulator 310 which in turn is connected to an auxiliary operating mechanism 317. Auxiliary operating mechanism may take the form of the mechanism illustrated in U.S. Pat. Nos. 3,769,477 and 3,696,729 as well as the mechanism disclosed in co-pending application Ser. No. 670742 assigned to the same assignee as the present invention. All of these mechanisms are adaptable to work with the auxiliary operating linkage assembly shown in FIGS. 15 and 16. Mechanism 317 is remotely controlled by appropriate control circuitry and operates to rotate insulator 310 at appropriate times when it is desired to interrupt current through the circuit.

When insulator 310 is rotated by an auxiliary mechanism 317, shaft 306 is also rotated so that actuating lever 316 is pivoted to the position illustrated by the dotted lines in FIG. 15. This causes the hook tip 330 of actuating arm 328 to engage the hook end 104 of trip latch 100 pulling trip latch 100 and main toggle latch 108 out of the overcenter toggle position so that the toggle members collapse allowing operating of the mechanism as previously described.

As actuating arm 328 is moved as actuating lever 316 is pivoted, stud 360 rides along the edge of actuating arm 328 until it engages cam 362. When stud engages cam 362 it causes operating arm 328 to pivot around pin 326 to the position illustrated in the dotted lines in FIG. 15 so that hook tip 330 no longer engages the hook end 104 of trip latch 100. This feature prevents the auxiliary mechanism from interfering with the recocking of the mechanism 10 after operation. For example, if shaft 306 or the auxiliary mechanism should for some reason become frozen in the operated position, the mechanism 10 can still be recocked and the interrupter switches 24 and 26 closed without interference from the auxiliary mechanism since arm 328 disengaged trip latch 100.

Figure 19:
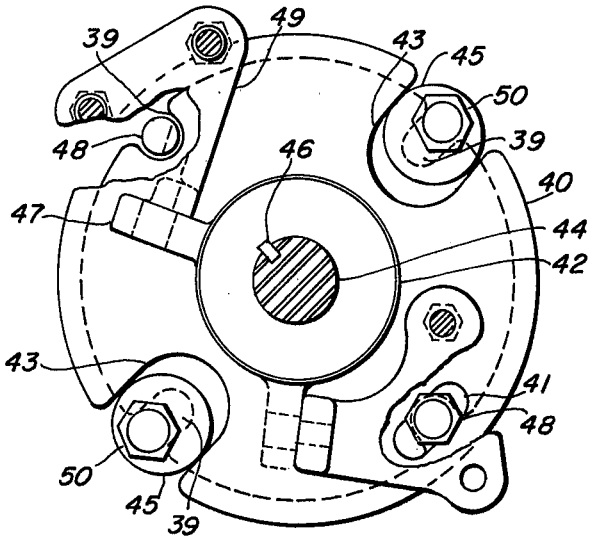
FIG. 19 is a top partially cross-sectional view of an aligning and locking arrangement in accordance with the present invention.

With reference to FIG. 19, flange assembly 36 provides a unique alignment and locking arrangement used to radially adjust the insulator 18 with respect to shaft 44. Guide ring 38 is dimensioned to fit within the recess on the bottom of base plate 40 to radially align these two members. Guide ring 38 has slots 39 equally spaced around the periphery thereof for receiving bolts 48 and 50. Base plate 40 has slots 41 through which bolts 48 are inserted and which permit base plate 40 to be pivoted with respect to guide ring 38. Base plate 40 also has two larger slots 43 communicating with the periphery of base plate 40 in which are positioned eccentric disks 42 having an offcenter hole therethrough through which bolts 50 are inserted. Flange 47 on cylindrical support 42 has an opening therethrough through which a bolt can be inserted and threaded into aligning flange 49 mounted to the bottom of mechanism 10 so that the proper angular alignment can be achieved and held between insulator and shaft 44 during assembly. Once the proper angular alignment is achieved, bolts 48 and 50 are tightened. The eccentric disks 45 can be rotated within slot 43 and then locked with bolts 50 to help to prevent subsequent rotation of the base plate 40 with respect to the guide ring 38 and insulator 18. Thus, despite the adjustment slots in base plate 40 and guide ring 38, rotation of the correct angular alignment is not dependent merely upon the friction between the heads of the bolts 48 and the surface of base plate 40.

An additional advantage of the present invention over prior art mechanisms is the use of two sets of two springs each for biasing separately the main rod arm assembly 66 and the first rod arm assembly 42. This feature provides a more balanced system with greater efficiency and less bearing friction.

It should be expressly understood that various alterations, changes, and modifications can be made to the structure of the preferred embodiment illustrated and described herein without departing from the spirit and scope of the present invention as described in the appended claims.

We claim:

1. In a high voltage switch arrangement, the switch arrangement comprising a base, supporting insulators mounted on the base, a first and a second current interrupter mounted on the supporting insulators, each current interrupter including main contact rods connected to separable main contacts that carry continuous high voltage current when closed and interrupting contact rods connected to separable interrupting contacts that interrupt high voltage current when separated, a rotatable insulator mounted on the base adapted for rotation by a driven mechanism; an improved switch operating mechanism comprising:

a housing;

a shaft rotatably mounted in the housing and extending through an opening in the housing, said shaft being connected for rotation with said rotatable insulator;

a main drive lever mounted on the shaft for rotation with the shaft, said main drive lever including cam means;

a main rod arm assembly mounted for rotation around the shaft independent of the rotation of said main drive lever and said shaft, said main rod arm assembly being operably connected to the main contact rods;

a fast rod arm assembly mounted for rotation around the shaft independent of the rotation of said main drive lever and said shaft, said fast rod arm assembly being operably connected to the interrupting contact rods;

first bias means urging said main rod arm assembly to rotate in a direction to cause the main contact rods to move to open the main contacts;

second bias means urging said fast rod assembly to rotate in a direction to cause the interrupting contact rods to move to open the interrupting contacts;

first overcenter toggle linkage means operably connected to said main rod arm assembly for preventing rotation of said main rod assembly when said first overcenter toggle linkage means is in an overcenter toggle position;

second overcenter toggle linkage means operably connected to said fast rod arm assembly for preventing rotation of said fast rod arm assembly when said second overcenter toggle linkage means is in an overcenter toggle position;

latch means mounted on said first overcenter toggle linkage means for engaging said cam means on said main drive lever when said main drive lever is rotated by said shaft and for moving said first overcenter toggle linkage means out of the overcenter toggle position so that said main rod arm assembly is rotated under the urging of said first bias means to open the main contacts;

means associated with said main rod arm assembly and positioned for engaging said second overcenter toggle linkage means after a predetermined amount of rotation of said main rod arm assembly when rotated to open the main contacts and for moving said second overcenter toggle linkage means out of the overcenter toggle position so that said fast rod arm assembly is rotated under the urging of said second bias means to open the interrupting contacts.

2. An improved mechanism, as claimed in claim 1, further comprising recocking means for rotating said main rod arm assembly and said fast rod arm assembly in a direction against the urging of said first and second bias means to close the main and interrupting contacts and move said first and second overcenter toggle linkage means back into the overcenter toggle position by continued rotation of said shaft in the same direction.

3. An improved mechanism, as claimed in claim 2, wherein said recocking means comprises abutting flanges on said main drive lever adapted to engage and rotate said main rod arm assembly and said fast rod arm assembly as said drive lever is rotated.

4. An improved mechanism, as claimed in claim 1, wherein said main rod arm assembly includes first abutments positioned thereon for engaging second abutments on said fast rod arm assembly when said main rod arm assembly is rotated and thereby transferring kinetic energy from said main rod arm assembly to said fast rod arm assembly after said second overcenter toggle linkage means is moved out of the overcenter toggle position.

5. An improved mechanism, as claimed in claim 1, further comprising pryout means for applying direct leverage force from said main drive lever to said main rod arm assembly to rotate said main rod arm assembly if said first bias means does not provide sufficient force to separate the main contacts after said first overcenter toggle linkage means moves out of the overcenter toggle position.

6. An improved mechanism, as claimed in claim 1, further comprising alignment means for permitting angular alignment between said shaft and the rotatable insulator and securely locking said shaft and rotatable insulator in the correct angular alignment.

7. An improved mechanism, as claimed in claim 1, further comprising indicator means for indicating the position of the current interrupter contacts.

8. An improved mechanism, as claimed in claim 1, further comprising auxiliary operating means for causing said first overcenter toggle linkage means to move out of the overcenter toggle position independent of the rotation of said shaft.

9. A mechanism, as claimed in claim 1, wherein said cam means is adjustably mounted on said drive lever so that the position at which said cam means engages said latch means can be adjusted.

10. A mechanism, as claimed in claim 1, wherein said second overcenter toggle linkage means includes a roller assembly positioned to engage said kicker means when said main rod arm assembly is rotated to move said second overcenter toggle linkage means out of the overcenter toggle position.

11. A mechanism, as claimed in claim 10, wherein said roller assembly includes first resilient means for absorbing the shock when said kicker means engages said roller assembly.

12. A mechanism, as claimed in claim 10, wherein said kicker means includes second resilient means for absorbing the shock when said kicker means engages said roller assembly.

13. A mechanism, as claimed in claim 5, wherein said pryout means comprises a pryout link connected between said latch means and said main rod arm assembly so that if said first bias means does not rotate said main rod arm assembly when said first overcenter toggle linkage means moves out of the overcenter toggle position, continued rotation of said shaft and said main drive lever causes said latch means to pull said pryout link in a direction to cause the pryout link to exert a force on said main rod arm assembly to cause said main rod arm to rotate to open the main contacts.

14. A mechanism, as claimed in claim 6, wherein said alignment means comprises:

a circular guide ring having at least four radially aligned first slots formed around the periphery thereof;

a circular base plate having a recess formed in the bottom thereof for receiving said guide ring, said base plate including second slots formed therethrough overlying at least two of said first slots and third slots formed therethrough overlying at least two other of said first slots;

eccentric disks positioned in said third slots having offcenter openings therethrough overlying said at least two other of said first slots;

first bolts positioned through said second slots and said at least two first slots and threaded into the first rotatable insulator;

second bolts positioned through said offcenter openings in said eccentric disks and through said at least two other of said first slots and threaded into the first rotatable insulator.

15. An improved mechanism, as claimed in claim 7, wherein said indicator means comprises:

a first target sleeve of a first color externally viewable to an operator through a window in said housing;

a second target sleeve of a second color;

means for moving said second target sleeve over said first target sleeve when the main contact rods are moved to open the main contacts so that the second color is visible and the operator can visually determine that the contacts are open.

16. A mechanism, as claimed in claim 8, wherein said auxiliary operating means comprises:

an auxiliary shaft rotatably mounted in said housing;

an actuating lever mounted on the shaft;

an actuating arm pivotably mounted on said actuating lever, said actuating arm adapted for releaseably engaging said first overcenter toggle linkage means and moving said first overcenter toggle linkage means out of the overcenter toggle position when said auxiliary shaft is rotated.

17. A mechanism, as claimed in claim 1, wherein said first bias means comprises at least one tension spring, and said second bias means comprises at least one tension spring.

18. In a high voltage interrupter switch arrangement, the interrupter switch arrangement comprising a base, supporting insulators mounted on the base, a first and a second current interrupter mounted on the supporting insulators, the first and second current interrupters including main contact rods connected to separable main contacts that carry continuous high voltage current when closed and interrupting contact rods connected to separable interrupting contacts that interrupt high voltage current when separated, a first rotatable insulator mounted on the base adapted for rotation by a first driving mechanism and a second driving mechanism mounted on the base connected to a second rotatable insulator; and improved switch operating mechanism comprising:

a housing;

a first shaft rotatably mounted in the housing and extending through an opening in the housing, said shaft being connected to the first rotatable insulator for rotation with the first rotatable insulator;

a main rod arm assembly mounted for rotation around said first shaft independent of the rotation of said first shaft, said main rod arm assembly being operably connected to the main contact rods;

a fast rod arm assembly mounted for rotation around said first shaft independent of the rotation of said first shaft, said first rod arm assembly being operably connected to the interrupter contact rods;

first bias means urging said main rod arm assembly to rotate in a direction to cause the main contact rods to move to open the main contacts;

second bias means urging said fast rod assembly to rotate in a direction to cause the interrupter contact rods to move to open the interrupter contacts;

first overcenter toggle linkage means operably connected to said main rod arm assembly for preventing rotation of said main rod assembly when said first overcenter toggle linkage means is in an overcenter toggle position;

second overcenter toggle linkage means operably connected to said fast rod arm assembly for preventing rotation of said fast rod arm assembly when said second overcenter toggle linkage means is in an overcenter toggle position;

a second shaft rotatably mounted in the housing and extending through another opening in the housing, said second shaft being connected to the second rotatable insulator for rotation with the second rotatable insulator;

an actuating lever rigidly mounted on said second shaft;

an actuating arm pivotably mounted on said actuating lever;

latch means mounted on said first overcenter toggle linkage means for engaging said actuating arm on said actuating lever when said actuating lever is rotated by said second shaft and for moving said first overcenter toggle linkage means out of the overcenter toggle position so that said main rod arm assembly is rotated under the urging of said first bias means to open the main contacts;

kicker means associated with said main rod arm assembly and positioned for engaging said second overcenter toggle linkage means after a predetermined amount of rotation of said main rod arm assembly when rotated to open the main contacts and for moving said second overcenter toggle linkage means out of the overcenter toggle position so that said fast arm assembly is rotated under the urging of said second bias means to open the interrupting contacts.

19. An improved mechanism, as claimed in claim 18, further comprising recocking means for recocking said main rod arm assembly and said fast rod arm assembly in a direction against the urging of said first and second bias means to close the main and interrupter contacts and move said first and second overcenter toggle linkage means back into the overcenter toggle position by rotation of said first shaft.

20. An improved mechanism, as claimed in claim 19, wherein said recocking means comprises a main drive lever mounted on said first shaft having abutments for engaging said main rod arm assembly and said fast rod arm assembly when said first shaft is rotated.

21. In a circuit interrupting mechanism, the arrangement comprising a base, at least one rotatable support insulator, a driven mechanism mounted on the rotatable support insulator for operation by rotation of the rotatable support insulator; an improved adjustable coupling joining the driven mechanism and the rotatable insulator comprising:

a plurality of bolts for engaging a plurality of threaded holes in an end of said rotatable support insulator;

a circular guide member having a plurality of openings around its periphery coinciding with the plurality of threaded holes;

a base plate member coupled to said driven mechanism, said base plate member having a plurality of openings coinciding with the threaded holes, at least some of said openings being substantially larger than said openings on said guide member; means for retaining said base plate member and said guide member in a coaxial relationship;

a plurality of circular disks, having an outside diameter which closely fits the width of said at least some substantially larger openings, said disks each having an eccentric hole formed therethrough parallel to but offset from the disk axis, each of said holes having a diameter just larger than the diameter of said bolts, said disks being placed in said at least some substantially larger openings, some of said plurality of bolts being placed in each opening in said plate member and screwed into said rotatable insulator, thereby holding said guide member between said insulator and said base plate member, some of said plurality of bolts being placed through said eccentric holes in said disks and screwed into said rotatable insulator, thereby holding said guide member between said disks and said insulator, so that as said bolts are tightened into said rotatable insulator, said disks lock said driven flange against rotation relative to the insulator axis and movement of said driven flange along the insulator axis will be prevented by the bolts screwed through the openings in said base plate member.

* * * * *